US011412860B2

(12) United States Patent
Spinks et al.

(10) Patent No.: US 11,412,860 B2
(45) Date of Patent: Aug. 16, 2022

(54) POCKETED SPRING UNIT AND METHOD OF MANUFACTURE

(71) Applicant: HS PRODUCTS LIMITED, Leeds (GB)

(72) Inventors: Simon Spinks, Leeds (GB); David Clare, Leeds (GB)

(73) Assignee: HS PRODUCTS LIMITED, Leeds (GB)

( * ) Notice: Subject to any disclaimer, the term of this patent is extended or adjusted under 35 U.S.C. 154(b) by 44 days.

(21) Appl. No.: 16/615,993

(22) PCT Filed: May 30, 2018

(86) PCT No.: PCT/GB2018/051469

§ 371 (c)(1),
(2) Date: Nov. 22, 2019

(87) PCT Pub. No.: WO2018/220366

PCT Pub. Date: Dec. 6, 2018

(65) Prior Publication Data

US 2020/0138201 A1 May 7, 2020

(30) Foreign Application Priority Data

May 31, 2017 (GB) ..... 1708635

(51) Int. Cl.
*A47C 27/06* (2006.01)
*A47C 27/045* (2006.01)
*A47C 27/07* (2006.01)

(52) U.S. Cl.
CPC ..... *A47C 27/064* (2013.01); *A47C 27/0453* (2013.01); *A47C 27/07* (2013.01)

(58) Field of Classification Search
CPC . A47C 27/0453; A47C 27/063; A47C 27/064; A47C 27/068; A47C 27/07
(Continued)

(56) References Cited

U.S. PATENT DOCUMENTS 274,715 A 3/1883 Buckley
380,651 A 4/1888 Fowler et al.
(Continued)

FOREIGN PATENT DOCUMENTS

CA 2225304 A1 6/1998
CN 2903019 Y 5/2007
(Continued)

OTHER PUBLICATIONS

International Search Report and Written Opinion issued by the International Searching Authority, the European Patent Office, for International Application No. PCT/GB2018/051469, dated Aug. 23, 2018, 9 pages.
(Continued)

*Primary Examiner* — Michael Safavi
(74) *Attorney, Agent, or Firm* — Gesmer Updegrove LLP

(57) ABSTRACT

A resilient unit has strings of individual coil springs (not shown) inside pockets 120 are arranged in an array. The strings together form a spring unit and are each secured to a common cover sheet S, which comprises a non-woven elastic fabric. It is welded ultrasonically or thermally whilst under tension in one or both of its major dimensions—i.e. in-plane—to the pockets 120, the material of which is substantially inelastic and non-woven. In this example the welds, labelled W, are located substantially centrally with respect to the generally circular end surfaces of the pockets.

25 Claims, 4 Drawing Sheets

(58) Field of Classification Search
USPC ..... 5/654.1, 655.7, 716, 717, 720, 721
See application file for complete search history.

(56) References Cited

U.S. PATENT DOCUMENTS 653,155 A 7/1900 Tilden
1,480,796 A 1/1924 Van Orman
1,531,547 A 3/1925 Edelson et al.
1,561,468 A 11/1925 Jordan et al.
1,852,943 A 4/1932 Swanson
1,896,670 A 2/1933 Garst
1,915,264 A 6/1933 Schneider et al.
1,963,053 A 6/1934 Powers
1,963,054 A 6/1934 Powers
2,114,008 A 4/1938 Wunderlich
2,250,042 A 7/1941 Sundt et al.
2,276,002 A 3/1942 Torok
2,388,106 A 10/1945 Woller
2,461,062 A 2/1949 Kane
2,716,308 A 8/1955 Hodges, Jr.
3,073,565 A 1/1963 Daumy
3,319,447 A 5/1967 Wise
3,355,747 A 12/1967 Ross
3,462,779 A 8/1969 Thompson
3,990,587 A 11/1976 Redman
4,018,956 A 4/1977 Casey
4,077,619 A 3/1978 Borlinghaus
4,109,443 A 8/1978 Findlay
4,111,407 A 9/1978 Stager
4,160,544 A 7/1979 Higgins
4,365,767 A 12/1982 Benthimere
4,397,453 A 8/1983 Seecamp
4,439,977 A 4/1984 Stumpf
4,485,506 A 12/1984 Stumpf et al.
4,529,848 A 7/1985 Cherry
4,549,323 A 10/1985 Brockhaus
4,711,067 A 12/1987 Magni et al.
4,733,036 A 3/1988 Koizumi et al.
4,809,375 A 3/1989 Bull
4,881,393 A 11/1989 Sykes
4,961,982 A 10/1990 Taylor
4,986,634 A 1/1991 Horikawa et al.
5,023,970 A 6/1991 Tesch
5,040,255 A * 8/1991 Barber, Jr. ..... A47C 27/066 5/720
5,127,635 A 7/1992 Long et al.
5,311,624 A 5/1994 Hutchinson
5,425,531 A 6/1995 Perrault
5,438,718 A 8/1995 Kelly et al.
5,467,489 A 11/1995 Cchen
5,488,746 A 2/1996 Hudson
5,501,317 A 3/1996 Sommer et al.
5,503,375 A 4/1996 Balsells
5,586,511 A * 12/1996 Porter ..... D05B 11/005 112/2.1
5,669,093 A 9/1997 Ogle et al.
5,791,638 A 8/1998 Balsells
5,878,998 A 3/1999 Hsieh
5,885,407 A 3/1999 Mossbeck
5,957,438 A 9/1999 Workman et al.
5,966,759 A 10/1999 Sanders et al.
5,987,668 A 11/1999 Ackley
6,036,181 A 3/2000 Workman
6,049,959 A 4/2000 Grondahl
6,085,397 A 7/2000 Workman et al.
6,131,892 A * 10/2000 Stumpf ..... A47C 27/064 267/89
6,159,319 A 12/2000 Mossbeck
6,173,464 B1 1/2001 McCune et al.
6,175,997 B1 1/2001 Mossbeck
6,176,961 B1 * 1/2001 Mossbeck ..... B05B 13/0463 156/291
6,220,586 B1 4/2001 Pavlin et al.
6,256,820 B1 * 7/2001 Moser ..... A47C 27/062 267/166
6,260,223 B1 7/2001 Mossbeck et al.
6,260,331 B1 7/2001 Stumpf
6,341,767 B1 1/2002 Seale et al.
6,397,418 B1 6/2002 Stjerna
6,398,199 B1 6/2002 Barber
6,408,514 B1 6/2002 Mossbeck et al.
6,574,811 B1 6/2003 Mossbeck
6,631,529 B1 10/2003 Erickson
6,684,435 B1 * 2/2004 Wells ..... A47C 27/062 5/248
6,684,608 B2 2/2004 Gibbons
6,688,457 B2 2/2004 Haubert et al.
6,718,726 B1 4/2004 Kuchel et al.
6,804,847 B2 10/2004 Grothaus
6,883,196 B2 * 4/2005 Barber ..... A47C 27/064 5/655.8
6,922,895 B1 8/2005 Whitworth
6,931,685 B2 8/2005 Kuchel et al.
7,100,862 B2 9/2006 Skarzenski et al.
7,178,187 B2 2/2007 Barman et al.
7,644,461 B2 * 1/2010 Lee ..... A47C 27/04 5/720
7,827,637 B2 11/2010 DeFranks
7,850,153 B2 12/2010 Bock
7,877,964 B2 2/2011 Spinks et al.
7,997,397 B2 8/2011 Akiyoshi
8,011,046 B2 9/2011 Stjerna
8,087,114 B2 1/2012 Lundevall
8,167,285 B2 5/2012 Balsells
8,266,745 B2 9/2012 Mossbeck
8,307,523 B2 11/2012 Mossbeck et al.
8,382,653 B2 2/2013 Dubi et al.
2002/0124321 A1 9/2002 Wells
2002/0124531 A1 9/2002 Mossbeck et al.
2003/0217413 A1 * 11/2003 Grothaus ..... A47C 27/04 5/655.8
2004/0025256 A1 * 2/2004 Mossbeck ..... A47C 27/062 5/655.8
2004/0070128 A1 4/2004 Balsells
2004/0103618 A1 6/2004 De Santis et al.
2004/0128773 A1 * 7/2004 Barber ..... F16F 1/08 5/716
2004/0172767 A1 * 9/2004 Mossbeck ..... A47C 27/064 5/720
2004/0206051 A1 10/2004 Gecic et al.
2005/0007441 A1 1/2005 Hyuga
2005/0055778 A1 3/2005 Kuchel et al.
2005/0224626 A1 10/2005 Pfeifer
2005/0257883 A1 11/2005 Anagnostopoulos
2006/0075567 A1 4/2006 DeFranks
2006/0236462 A1 10/2006 Boyd
2006/0272098 A1 12/2006 Hochschild
2006/0272928 A1 12/2006 Kritzinger
2007/0022538 A1 * 2/2007 Zschoch ..... A47C 27/04 5/655.8
2007/0022540 A1 2/2007 Hochschild
2007/0101507 A1 * 5/2007 Grothaus ..... A47C 27/065 5/716
2007/0124865 A1 * 6/2007 Stjerna ..... A47C 27/063 5/720
2007/0199155 A1 8/2007 Thygsen
2007/0216076 A1 9/2007 Ahn
2007/0235915 A1 10/2007 Ahn
2007/0256246 A1 11/2007 Gladney et al.
2008/0054688 A1 3/2008 Longnecker
2008/0189824 A1 8/2008 Rock et al.
2008/0246197 A1 10/2008 Mossbeck et al.
2009/0079113 A1 3/2009 Martin
2009/0266032 A1 10/2009 Spinks et al.
2010/0212090 A1 8/2010 Stjerna
2010/0326012 A1 12/2010 Blunschi
2011/0209514 A1 9/2011 Huon
2012/0112396 A1 5/2012 DeFranks et al.
2012/0260422 A1 10/2012 Rock et al.
2013/0334747 A1 12/2013 Spinks
2014/0033440 A1 2/2014 Tyree
2014/0033441 A1 2/2014 Morgan et al.
2015/0026893 A1 1/2015 Garrett et al.

(56) References Cited

U.S. PATENT DOCUMENTS

| | | | | |
|---|---|---|---|---|
| 2015/0084251 | A1 | 3/2015 | Ahn | |
| 2016/0249744 | A1* | 9/2016 | Eigenmann | A47C 21/042 5/655.8 |
| 2016/0354820 | A1 | 12/2016 | Katou | |
| 2017/0008756 | A1 | 1/2017 | Clare et al. | |
| 2017/0137754 | A1 | 5/2017 | Callahan | |
| 2017/0340130 | A1 | 11/2017 | Mossbeck | |
| 2017/0354267 | A1* | 12/2017 | Alletto, Jr. | A47C 27/07 |
| 2018/0168360 | A1* | 6/2018 | Thomas | A47C 27/062 |
| 2019/0000239 | A1* | 1/2019 | Thomas | A47C 27/07 |
| 2019/0290015 | A1* | 9/2019 | Fisher | A47C 27/15 |
| 2020/0281367 | A1* | 9/2020 | DeMoss | A47C 27/05 |

FOREIGN PATENT DOCUMENTS

| | | | | |
|---|---|---|---|---|
| CN | 101140019 | A | 3/2008 | |
| CN | 201777876 | U | 3/2011 | |
| CN | 201890767 | U | 7/2011 | |
| CN | 202112703 | U | 1/2012 | |
| CN | 203740239 | U | 7/2014 | |
| DE | 899008 | C | 12/1953 | |
| DE | 3143269 | A1 | 5/1983 | |
| DE | 3514042 | A1 | 10/1986 | |
| DE | 4031651 | A1 * | 4/1992 | A47C 27/064 |
| DE | 4031654 | A1 * | 4/1992 | A47C 27/064 |
| DE | 4040220 | A1 * | 6/1992 | A47C 23/0438 |
| DE | 4225147 | A1 | 9/1993 | |
| DE | 4419206 | C1 | 3/1995 | |
| DE | 19529911 | A1 | 2/1997 | |
| DE | 10244766 | A1 | 5/2003 | |
| DE | 102008061465 | B3 | 8/2009 | |
| EP | 0089789 | A1 | 9/1983 | |
| EP | 0089789 | A1 * | 9/1983 | A47C 27/062 |
| EP | 252211 | A2 | 1/1988 | |
| EP | 0359035 | A1 | 3/1990 | |
| EP | 0401318 | A1 | 12/1990 | |
| EP | 0558078 | A1 | 9/1993 | |
| EP | 0899034 | A2 | 3/1999 | |
| EP | 0941962 | A1 | 9/1999 | |
| EP | 0943445 | A2 | 9/1999 | |
| EP | 1993947 | A1 | 11/2008 | |
| EP | 1993947 | B1 | 3/2014 | |
| EP | 2565152 | B1 | 6/2014 | |
| ES | 2270477 | T3 | 4/2007 | |
| FR | 2171782 | A5 | 9/1973 | |
| FR | 2561620 | A1 | 9/1985 | |
| FR | 2606756 | A1 | 5/1988 | |
| FR | 2780624 | A1 | 1/2000 | |
| GB | 947298 | A | 1/1964 | |
| GB | 1461671 | A | 1/1977 | |
| GB | 2056336 | A | 3/1981 | |
| GB | 2437825 | A | 11/2007 | |
| GB | 2477139 | A | 7/2011 | |
| GB | 2488214 | A | 8/2012 | |
| GB | 2537854 | A | 11/2016 | |
| GB | 2576216 | A * | 2/2020 | A47C 27/064 |
| GB | 2523895 | B * | 12/2020 | B68G 9/00 |
| JP | 55157452 | U | 5/1976 | |
| JP | 56090136 | A | 7/1981 | |
| JP | 560165121 | U | 11/1985 | |
| JP | S6134950 | U | 3/1986 | |
| JP | S6155867 | U | 4/1986 | |
| JP | 59212545 | A | 10/1989 | |
| JP | 2001340175 | A | 12/2001 | |
| KR | 101008136 | B1 | 6/2005 | |
| SU | 846007 | A1 | 7/1981 | |
| WO | WO-9203077 | A1 * | 3/1992 | A47C 23/0438 |
| WO | 9530622 | A1 | 11/1995 | |
| WO | 9617701 | A1 | 6/1996 | |
| WO | 9635637 | A1 | 11/1996 | |
| WO | 9947830 | A2 | 9/1999 | |
| WO | 9956591 | A1 | 11/1999 | |
| WO | 0126507 | A1 | 4/2001 | |
| WO | 0145875 | A1 | 6/2001 | |
| WO | 03027840 | A1 | 4/2003 | |
| WO | 03035304 | A1 | 5/2003 | |
| WO | 03036874 | A2 | 5/2003 | |
| WO | 2004099004 | A1 | 11/2004 | |
| WO | 2006043862 | A1 | 4/2006 | |
| WO | 2007031774 | A1 | 3/2007 | |
| WO | 2007102772 | A1 | 9/2007 | |
| WO | 2009030017 | A1 | 3/2009 | |
| WO | 2009111801 | A2 | 9/2009 | |
| WO | 2010026477 | A2 | 3/2010 | |
| WO | 2011142549 | A2 | 11/2011 | |
| WO | 2013054104 | A1 | 4/2013 | |
| WO | 2014113737 | A1 | 7/2014 | |
| WO | 2015087557 | A1 | 6/2015 | |
| WO | 2015114361 | A1 | 8/2015 | |
| WO | WO-2015114363 | A1 * | 8/2015 | A47C 27/064 |
| WO | 2017137754 | A1 | 8/2017 | |
| WO | 2018220366 | A1 | 12/2018 | |
| WO | WO-2019034849 | A2 * | 2/2019 | B29C 66/8322 |
| WO | WO-2019034850 | A1 * | 2/2019 | A47C 27/07 |

OTHER PUBLICATIONS

"Fold," Mirriam-Webster.com, Merriam-Webster, n.d. Wednesday, Jan. 29, 2018, 1 page.

International Search Report and Written Opinion issued by the International Searching Authority in related International Application No. PCT/GB2011/052169 dated Jan. 16, 2012, 6 pages.

International Preliminary Report on Patentability issued by the International Bureau of WIPO dated May 14, 2013 in related International Application No. PCT/GB2011/052169, 4 pages.

Non-Final Office Action issued by the U.S. Patent and Trademark Office dated Aug. 7, 2015 in related U.S. Appl. No. 13/884,049, 8 pages.

Final Office Action issued by the U.S. Patent and Trademark Office dated Apr. 27, 2016 in related U.S. Appl. No. 13/884,049, 9 pages.

Non-Final Office Action issued by the U.S. Patent and Trademark Office dated Nov. 10, 2016 in related U.S. Appl. No. 13/884,049, 6 pages.

Final Office Action issued by the U.S. Patent and Trademark Office dated May 4, 2017 in related U.S. Appl. No. 13/884,049, 8 pages.

Non-Final Office Action issued by the U.S. Patent and Trademark Office dated Jan. 30, 2018 in related U.S. Appl. No. 13/884,049, 5 pages.

Non-Final Office Action issued by the U.S. Patent and Trademark Office dated Oct. 1, 2015 in related U.S. Appl. No. 14/351,060, 8 pages.

Final Office Action issued by the U.S. Patent and Trademark Office dated Jul. 22, 2016 in related U.S. Appl. No. 14/351,060, 10 pages.

Final Office Action issued by the U.S. Patent and Trademark Office dated Jun. 8, 2017 in related U.S. Appl. No. 14/351,060, 11 pages.

Non-Final Office Action issued by the U.S. Patent and Trademark Office dated Mar. 21, 2018 in related U.S. Appl. No. 14/351,060, 13 pages.

Final Office Action issued by the U.S. Patent and Trademark Office dated Jan. 8, 2019 in related U.S. Appl. No. 14/351,060, 12 pages.

Non-Final Office Action issued by the U.S. Patent and Trademark Office dated Sep. 24, 2019 in related U.S. Appl. No. 14/351,060, 11 pages.

International Preliminary Report on Patentability issued by the International Bureau of WIPO dated Apr. 15, 2014 in related International Application No. PCT/GB2012/052503, 5 pages.

International Search Report and Written Opinion issued by the International Searching Authority dated Feb. 12, 2013 in related International Application No. PCT/GB2012/052503, 8 pages.

International Preliminary Report on Patentability issued by the International Bureau of WIPO dated Feb. 10, 2015 in related International Application No. PCT/GB2013/052131, 5 pages.

International Search Report and Written Opinion issued by the International Searching Authority dated Nov. 5, 2013 in related International Application No. PCT/GB2013/052131, 7 pages.

Non-Final Office Action issued by the U.S. Patent and Trademark Office dated Oct. 2, 2015 in related U.S. Appl. No. 14/420,690, 8 pages.

(56) References Cited

OTHER PUBLICATIONS

Final Office Action issued by the U.S. Patent and Trademark Office dated Jun. 24, 2016 in related U.S. Appl. No. 14/420,690, 9 pages.
Non-Final Office Action issued by the U.S. Patent and Trademark Office dated Jun. 27, 2017 in related U.S. Appl. No. 14/420,690, 18 pages.
Final Office Action issued by the U.S. Patent and Trademark Office dated Sep. 20, 2017 in related U.S. Appl. No. 14/420,690, 18 pages.
Non-Final Office Action issued by the U.S. Patent and Trademark Office dated Sep. 25, 2018 in related U.S. Appl. No. 14/420,690, 15 pages.
Final Office Action issued by the U.S. Patent and Trademark Office dated Jun. 4, 2019 in related U.S. Appl. No. 14/420,690, 21 pages.
Non-Final Office Action issued by the U.S. Patent and Trademark Office dated Dec. 20, 2019 in related U.S. Appl. No. 14/420,690, 12 pages.
Search Report issued by British Intellectual Property Office in related British Patent Application No. 1214312.9 dated Nov. 6, 2012, 6 pages.
International Preliminary Report on Patentability issued by the International Bureau of WIPO dated Feb. 10, 2015 in related International Application No. PCT/GB2013/052129, 4 pages.
International Search Report and Written Opinion issued by the International Searching Authority dated Dec. 5, 2013 in related International Application No. PCT/GB2013/052129, 6 pages.
Non-Final Office Action issued by the U.S. Patent and Trademark Office dated Mar. 6, 2017 in related U.S. Appl. No. 14/420,692, 9 pages.
Final Office Action issued by the U.S. Patent and Trademark Office dated Sep. 20, 2017 in related U.S. Appl. No. 14/420,692, 8 pages.
Search Report issued by British Intellectual Property Office in related British Patent Application No. 1214305.3 dated Nov. 28, 2012, 3 pages.
International Preliminary Report on Patentability issued by the International Bureau of WIPO in related International Application No. PCT/GB2013/052130 dated Feb. 10, 2015, 5 pages.
International Search Report and Written Opinion issued by the International Searching Authority in related International Application No. PCT/GB2013/052130 dated Nov. 27, 2013, 7 pages.
Non-Final Office Action issued by the U.S. Patent and Trademark Office in related U.S. Appl. No. 14/420,691 dated Jun. 23, 2015, 4 pages.
Search Report issued by British Intellectual Property Office in related British Patent Application No. 1214314.5 dated Nov. 9, 2012, 4 pages.
International Preliminary Report on Patentability issued by the International Bureau of WIPO in related International Application No. PCT/GB2015/050235 dated Aug. 2, 2016, 11 pages.
International Search Report and Written Opinion issued by the International Searching Authority in related International Application No. PCT/GB2015/050235 dated May 28, 2015, 14 pages.
Non-Final Office Action issued by the U.S. Patent and Trademark Office dated Sep. 11, 2018 in related U.S. Appl. No. 15/115,451, 10 pages.
Final Office Action issued by the U.S. Patent and Trademark Office dated Apr. 11, 2019 in related U.S. Appl. No. 15/115,451, 9 pages.
Non-Final Office Action issued by the U.S. Patent and Trademark Office dated Jan. 30, 2020 in related U.S. Appl. No. 15/115,451, 10 pages.
Search Report issued by British Intellectual Property Office in related British Patent Application No. 1401597.8 dated Oct. 8, 2014, 5 pages.
International Preliminary Report on Patentability issued by the International Bureau of WIPO in related International Application No. PCT/GB2015/050236 dated Aug. 2, 2016, 7 pages.
International Search Report and Written Opinion issued by the International Searching Authority in related International Application No. PCT/GB2015/050236 dated Apr. 20, 2015, 10 pages.
Non-Final Office Action issued by the U.S. Patent and Trademark Office dated Dec. 7, 2018 in related U.S. Appl. No. 15/115,460, 9 pages.
Final Office Action issued by the U.S. Patent and Trademark Office dated Jun. 4, 2019 in related U.S. Appl. No. 15/115,460, 11 pages.
Search Report issued by British Intellectual Property Office in related British Patent Application No. 1401606.7 dated Jul. 24, 2014, 3 pages.
International Preliminary Report on Patentability issued by the International Bureau of WIPO in related International Application No. PCT/GB2018/051465 dated Dec. 3, 2019, 14 pages.
International Search Report and Written Opinion issued by the International Searching Authority in related International Application No. PCT/GB2018/051465 dated Mar. 22, 2019, 20 pages.
International Preliminary Report on Patentability issued by the International Bureau of WIPO in related International Application No. PCT/GB2018/052278 dated Feb. 18, 2020, 9 pages.
International Search Report and Written Opinion issued by the International Searching Authority in related International Application No. PCT/GB2018/052278 dated Apr. 10, 2019, 11 pages.
International Preliminary Report on Patentability issued by the International Bureau of WIPO in related International Application No. PCT/GB2018/052279 dated Feb. 18, 2020, 5 pages.
International Search Report and Written Opinion issued by the International Searching Authority in related International Application No. PCT/GB2018/052279 dated Nov. 9, 2018, 7 pages.
Search Report issued by British Intellectual Property Office in related British Patent Application No. 1713098.0 dated Feb. 6, 2019, 2 pages.
Search Report issued by British Intellectual Property Office in related British Patent Application No. 1708639.8 dated Nov. 22, 2017, 5 pages.
Search Report issued by British Intellectual Property Office in related British Patent Application No. 1713096.4 dated Feb. 11, 2019, 2 pages.
Final Office Action issued by the U.S. Patent and Trademark Office dated Jun. 17, 2020 in related U.S. Appl. No. 14/420,690, 41 pages.
Final Office Action issued by the U.S. Patent and Trademark Office in related U.S. Appl. No. 15/115,451 dated Jun. 12, 2020, 14 pages.
Non-Final Office Action issued by the U.S. Patent and Trademark Office in related U.S. Appl. No. 16/637,302 dated May 27, 2021, 7 pages.
Final Office Action issued by the U.S. Patent and Trademark Office in related U.S. Appl. No. 14/420,690 dated Sep. 15, 2021, 18 pages.

* cited by examiner

POCKETED SPRING UNIT AND METHOD OF MANUFACTURE

CROSS-REFERENCE TO RELATED APPLICATIONS

The present application is a U.S. National Stage filing under 35 U.S.C. 371(c) of International. Application No. PCT/GB2018/051469, filed May 30, 2018; which claims priority to application no. GB 1708635.6, filed May 31, 2017, the disclosures of which are hereby incorporated by reference in their entireties.

The present invention relates to a pocketed spring unit and to a method and an apparatus for forming the same, and is concerned particularly with a pocketed spring unit that has reduced adhesive as compared with previously considered units, or is substantially free from adhesive, and to a method for forming such a unit.

Pocketed springs, otherwise known as encased springs, are used in upholstered articles such as mattresses. An example is shown schematically in FIG. 1. A resilient pocketed spring unit 100 comprises coil springs 110 encased individually in pockets 120 of fabric material formed by folding over a sheet of fabric to form two leaves that envelope the springs, and then attaching the leaves together between the springs so as to form a string of individual springs in pockets. The strings are then joined to form an array of springs as a pocketed spring unit.

The joining of the strings together to form an array is usually achieved either by gluing the strings together along the cylindrical surfaces of the pocketed springs, one string to the next, and so on until the unit is formed, or else by arranging the strings beside each other in an array, and then gluing a sheet of fabric to the cylindrical ends of the pocketed springs, above and/or below, so as to form the unit.

A problem with either method is the extensive use of glue to hold together the strings, to form the unit. For one thing the adhesive forms a significant element of the cost of manufacturing a pocketed spring unit, and for another the presence of the adhesive in the product makes it difficult to recycle the unit at the end of its useful life.

One alternative structure is described in our United Kingdom patent application no. 1702159.3. As illustrated schematically in FIG. 2, a resilient unit 200, such as for a mattress, comprises a folded pad containing rows of resilient elements 210, which in this example are coil springs, in discrete pockets 220 formed between superposed sheets of material joined at locations between adjacent resilient elements. Between at least some adjacent resilient elements the sheets form a gusset 230 which acts as a hinge when the pad is fan-folded to form the resilient unit. The unit requires less glue to hold it together than the above example, due to the structural role of the gusset.

Embodiments of the present invention aim to provide a pocketed spring unit, and a method for manufacturing the same, in which the shortcomings of the prior art are addressed.

The present invention is defined in the attached independent claims, to which reference should now be made. Further, preferred features may be found in the sub-claims appended thereto.

According to one aspect of the present invention, there is provided a resilient unit, comprising a plurality of pocketed resilient elements arranged in an array, wherein at least some of the pocketed resilient elements are joined to a common cover sheet of elastic material.

The pocketed resilient elements may comprise resilient articles, such as springs, inside pockets formed of pocket material.

The pocket material may be substantially inelastic and/or it may have a degree of elasticity that is less than that of the cover sheet, more preferably substantially less.

Preferably the cover sheet is joined directly to the pocket material.

Preferably the pocketed resilient elements are joined to the common sheet by welds. Alternatively, or in addition, the pocketed resilient elements may be joined to the cover sheet by adhesive.

At least some of the resilient elements are arranged in use to be compressible along a compression axis. At least some of the resilient elements are arranged in use so that their compression axes are aligned and are preferably substantially parallel. In a preferred arrangement the cover sheet is arranged to extend in a direction substantially transverse to the compression axes of the resilient elements.

In a preferred arrangement the cover sheet is joined to the pocketed resilient elements at an upper side of the resilient unit in use. Alternatively the cover sheet is joined at a lower side of the resilient unit in use.

The resilient unit may comprise a cover sheet joined at each of the upper and lower sides.

In a preferred arrangement the, or each, cover sheet is joined to the pocket material of one or more of the pockets, more preferably to one or more folds in the pocket material.

Where the resilient units have one or more gussets or hinges between them, the or each cover sheet may be joined to one or more of the gussets.

In a preferred arrangement the or each cover sheet is attached to the pocketed resilient elements around at least a peripheral portion of the resilient unit.

The resilient unit may have a substantially planar upper and/or lower surface. The or each cover sheet may be joined at the planar surface.

According to another aspect of the present invention, there is provided a method of manufacturing a resilient unit, the unit comprising a plurality of pocketed resilient elements arranged in an array, wherein the method comprises joining at least some of the pocketed resilient elements to a cover sheet of elastic material.

The pocketed resilient elements may comprise resilient articles, such as springs, inside pockets formed of pocket material.

Preferably the method comprises joining at least some of the pocketed resilient elements to the cover sheet by welding, which may be by ultrasonic welding or thermal welding, for example. Alternatively, or in addition, the method may comprise joining at least some of the pocketed resilient elements to the cover sheet using adhesive.

In a preferred arrangement the cover sheet is arranged to extend in a direction substantially transverse to the compression axes of the resilient elements.

In a preferred arrangement the method comprises joining the cover sheet at an upper side of the resilient unit.

Alternatively, the method may comprise joining the cover sheet at a lower side of the resilient unit.

The method may comprise joining a cover sheet to each of the upper and lower sides.

In a preferred arrangement method comprises joining the, or each, cover sheet to one or more of the pockets, more preferably to one or more folds in the pocket material.

Where the resilient units have one or more gussets or hinges between them, method may include joining the or each cover sheet to one or more of the gussets.

In a preferred arrangement the method may include joining the or each cover sheet to the resilient unit around at least a peripheral portion thereof.

The resilient unit may have a substantially planar upper and/or lower surface. The method may comprise joining the or each cover sheet to the planar surface.

The invention also includes a resilient unit according to any statement herein or formed in accordance with a method according to any statement herein.

The invention also includes an upholstered article comprising a resilient unit in accordance with any statement herein.

The invention may include any combination of the features or limitations referred to herein, except such a combination of features as are mutually exclusive, or mutually inconsistent.

A preferred embodiment of the present invention will now be described, by way of example only, with reference to the accompanying diagrammatic drawings, in which.

Embodiments of resilient unit described below have a cover sheet that is elastic and pocket material that is substantially inelastic, or has a degree of elasticity that is less than that of the cover sheet, more preferably substantially less than that of the cover sheet.

Figure 1:
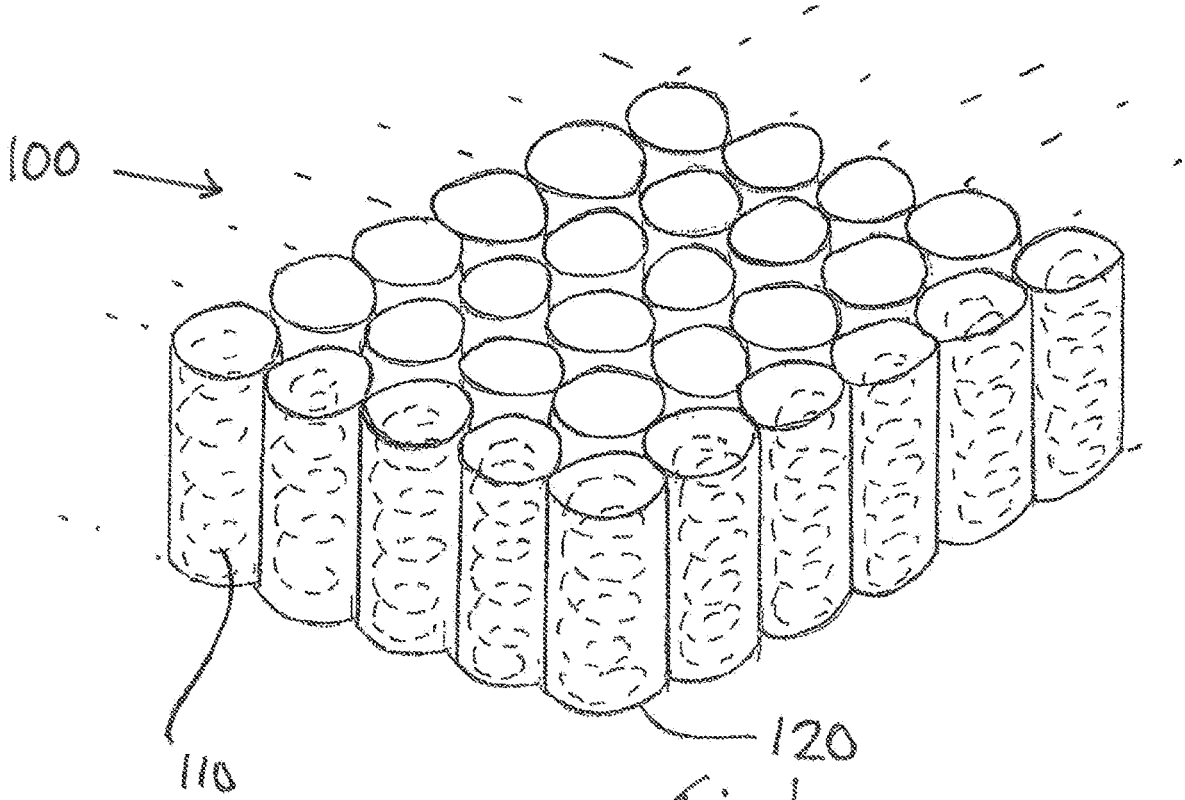
FIG. 1 shows schematically a first type of previously considered resilient unit.
Figure 2:
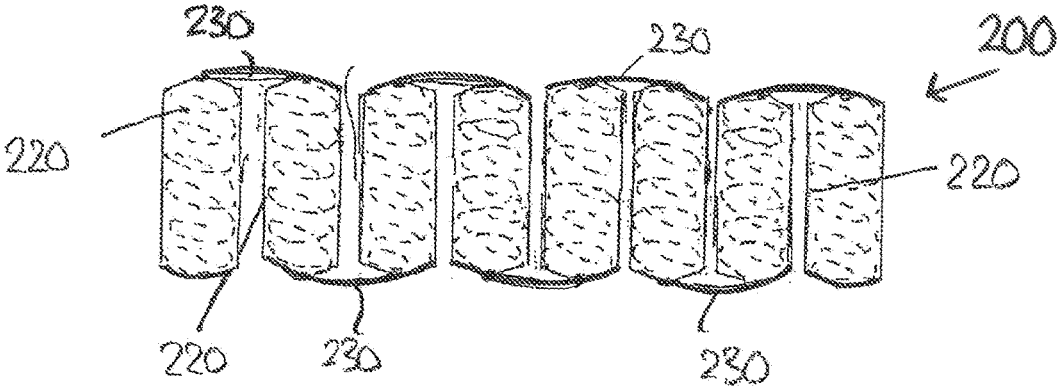
FIG. 2 shows schematically a second type of previously considered resilient unit.

Turning to FIG. 1, this shows the first type of resilient unit, in the form of a pocketed spring unit as described briefly above. FIG. 2 shows a second type of resilient unit as described above.

Figure 3:
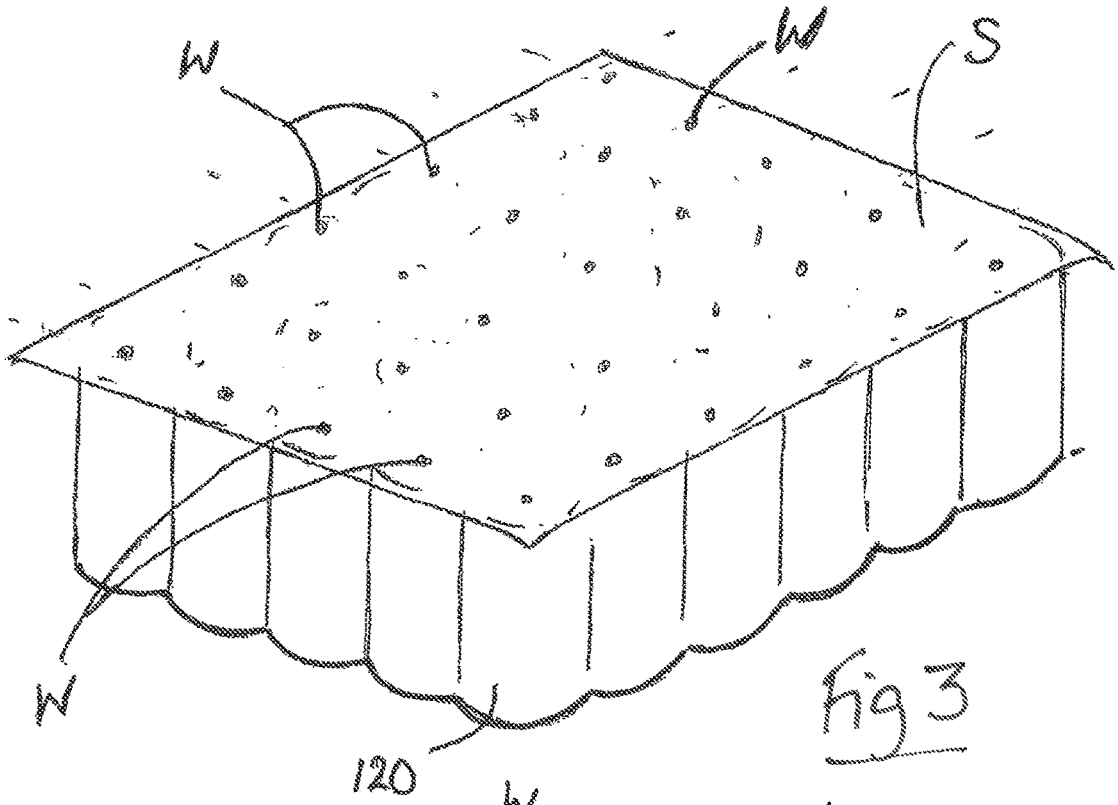
FIG. 3 shows schematically a portion of a resilient unit of a first type, modified in accordance with an embodiment of the present invention.

FIG. 3 shows schematically a part of a resilient unit according to an embodiment of the present invention. The resilient unit in this example is of the type described in relation to FIG. 1, in which strings of individual coil springs (not shown) inside pockets 120 are arranged in an array.

The strings together form a spring unit and are each secured to a common cover sheet S, which comprises a non-woven elastic fabric. It is welded ultrasonically or thermally whilst under tension in one or both of its major dimensions—i.e. in-plane—to the pockets 120, the material of which is substantially inelastic and non-woven. In this example the welds, labelled W, are located substantially centrally with respect to the generally circular end surfaces of the pockets.

The cover sheet S holds the strings of springs together, so that they do not need to be glued to each other, which saves cost.

Figure 4:
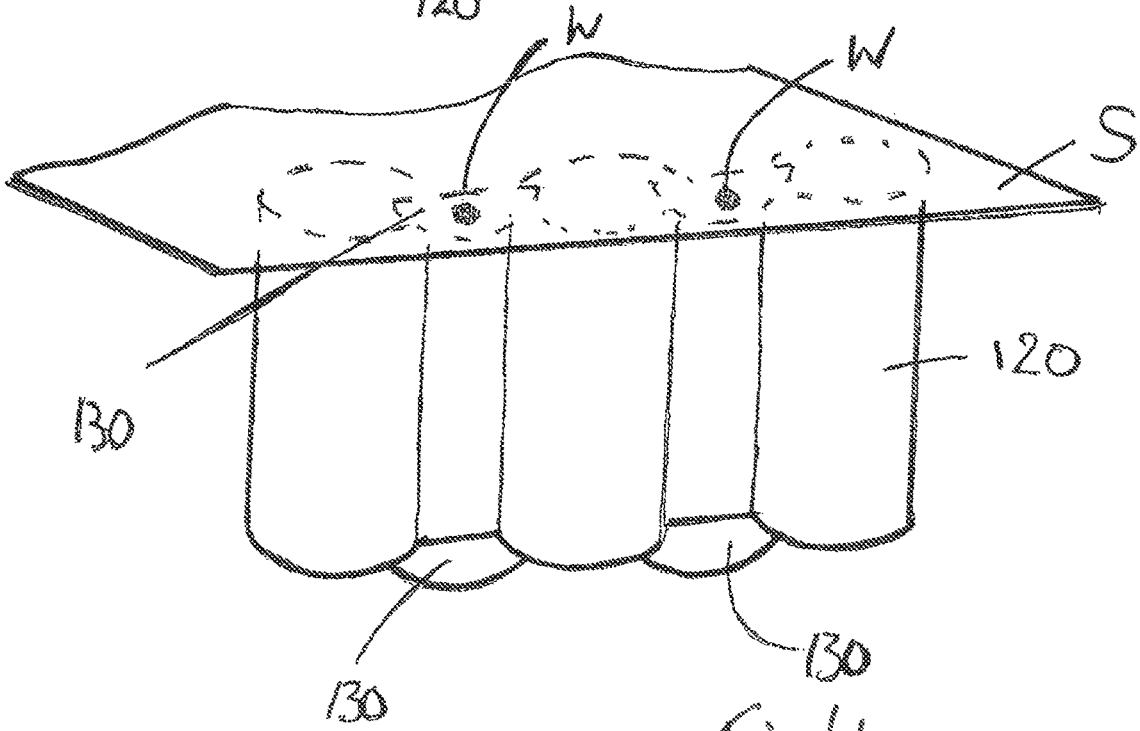
FIG. 4 shows schematically a portion of a resilient unit that is a variant of the embodiment of FIG. 3.
Figure 5:
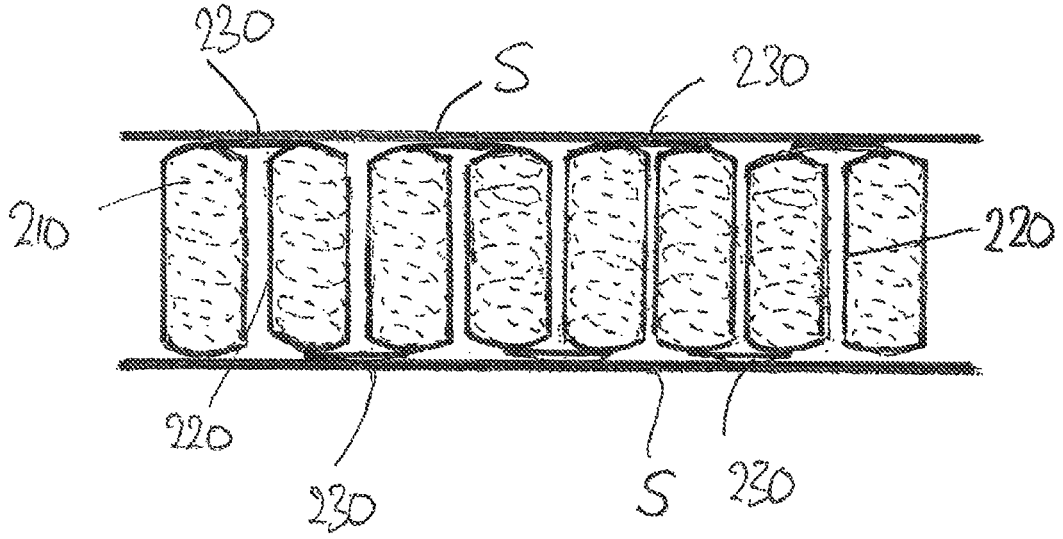
FIG. 5 shows schematically a portion of a resilient unit of a second type, modified in accordance with an embodiment of the present invention.

FIG. 4 shows a variant of the resilient unit of FIG. 1. The cylindrical coil springs are again encased in individual pockets 120. However, in this embodiment surplus material comprising the pockets is formed into flaps or ears 130 at the axial ends of the pockets. It is to these flaps 130 that the cover sheet S is welded at points W.

FIG. 4 shows the second type of resilient unit, as described above in relation to FIG. 2, with the modification that a cover sheet S has been welded thereto. As described above, the unit comprises a folded pad containing rows of resilient elements 210, in this example they are coil springs, in discrete pockets 220 formed between superposed sheets of material joined at locations between adjacent resilient elements. Between at least some adjacent resilient elements the sheets form a gusset 230 which acts as a hinge when the pad is folded to form the resilient unit.

Cover sheets S are welded to the gussets on both upper and lower surfaces of the pad. Again, the sheets are of an elastic material and are held under tension prior to welding. When welding is completed and the tension is released, the cover sheets S hold the pocketed springs securely in the folded configuration shown.

Figure 6:
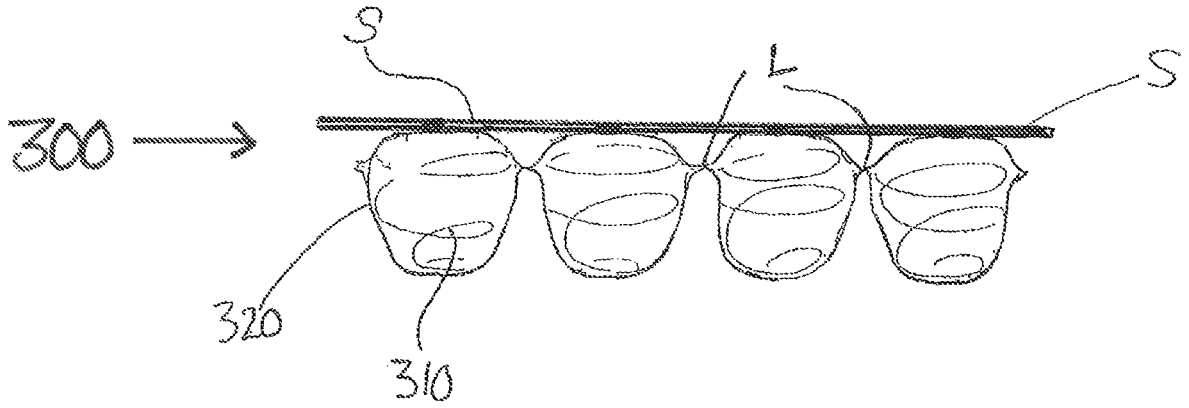
FIG. 6 shows schematically a portion of a resilient unit of a third type, modified in accordance with an embodiment of the present invention.

FIG. 6 shows schematically a portion of another type of pocketed spring unit 300. This example is of a kind made in accordance with the method described in our European patent number EP 1 993 947 B in which rows of springs 310 are encapsulated in pockets 320 formed between sheets of material that are welded together at locations L between the springs. The cover sheet S is welded to the upper sheet of pocket material.

Figure 7:
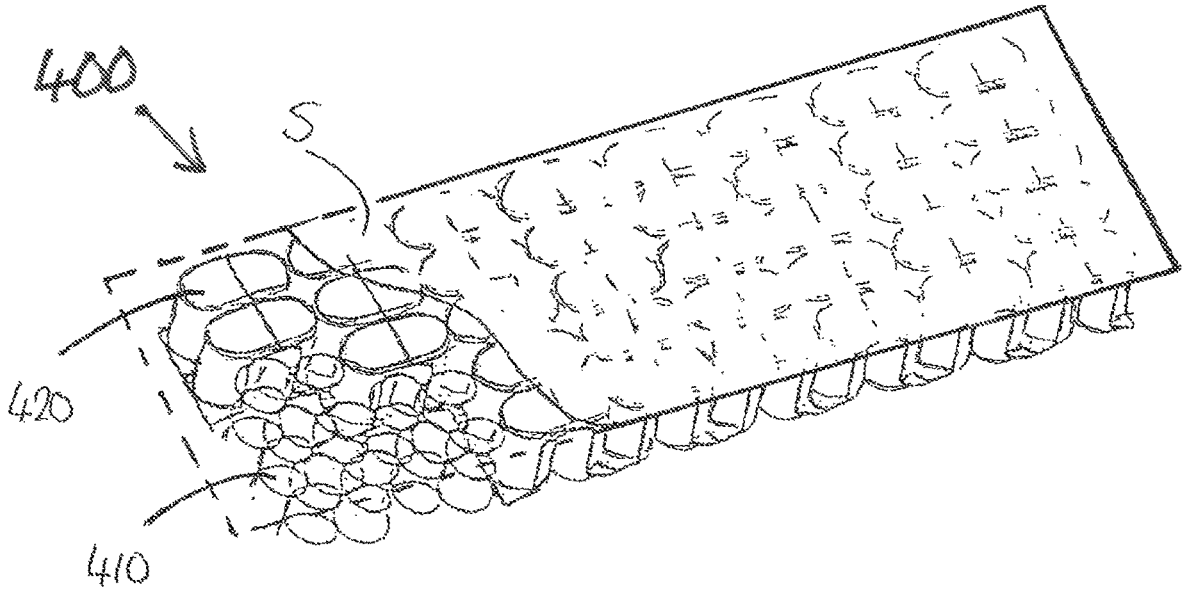
FIG. 7 shows schematically a portion of a resilient unit of a fourth type, modified in accordance with an embodiment of the present invention.

FIG. 7 shows schematically another type of pocketed spring unit 400. This example is of a unit such as is described in our European patent number EP 2 637 527 B in which a continuous coil spring 410 is encased in a continuous pocket 420, before the spring and pocket are deformed together simultaneously, by fan-folding. A plurality of encased springs, lying beside one another in an array, can be fan folded together to form the unit shown. The elastic cover sheet S is then welded under tension to the pocketing material. In FIG. 7 part of the cover sheet S and part of the pocketing have been removed to expose the structure beneath.

In the examples above, the elasticated cover sheet S holds the pocketed springs together, keeping the shape of the unit. The sheet may be made from an elastomeric polymer, combined with a non-elastic fibre, such as polypropylene.

The elasticity of the cover sheet adds to the resilient characteristic of the pocketed spring unit as a whole, and for example when used as an upholstered article, such as a mattress, it provides a luxurious feel. In addition, because the sheet S contributes to the resilience, the mass of spring wire may be reduced, for example by using wire of a thinner gauge.

Unlike previously considered cover sheets, which do not have elasticity, the elastic sheet S allows for the deformation of smaller clusters of pocketed springs—in some cases individual pocketed springs may be deformed—without communicating, or distributing, the compressive load widely, for example to surrounding springs/clusters. This can make for a responsive characteristic and can improve the feeling of comfort to the user.

The cover sheet S may be applied to an intended upper surface of the spring unit in use, or to an intended lower surface, or sheets can be applied to each of the upper and lower surfaces. A common sheet can be applied to both surfaces—eg by extending around a side of the unit. As an alternative, the or each sheet can form part of a bag or case that can extend around and substantially form the outer surface of the unit, substantially enclosing all of the pocket resilient elements.

Whereas the examples above show a cover sheet S that is welded ultrasonically or thermally to the pocketing material of the unit, the sheet could also be glued to the pocketing material. In this example, while the cost of the glue would not be eliminated completely, the quantity of glue would be reduced, particularly when compared with previous examples, in which each string of springs must be glued to its neighbours in order to maintain the strength and structural integrity of the finished unit.

Whilst endeavouring in the foregoing specification to draw attention to those features of the invention believed to be of particular importance, it should be understood that the applicant claims protection in respect of any patentable feature or combination of features referred to herein, and/or shown in the drawings, whether or not particular emphasis has been placed thereon.

The invention claimed is:

1. A resilient unit, comprising a plurality of resilient elements within pockets of substantially inelastic and non-woven material, arranged in an array, wherein at least two of the pocketed resilient elements are joined to a common cover sheet of non-woven elastic material, and wherein the cover sheet has two major dimensions and is under tension in one or both of said major dimensions and is joined to the pockets by welds or adhesive.

2. The resilient unit according to claim 1, wherein the pocketed resilient elements comprise springs inside pockets.

3. The resilient unit according to claim 1, wherein at least two of the resilient elements are arranged in use to be compressible along a compression axis.

4. The resilient unit according to claim 1 wherein at least two of the resilient elements are arranged in use so that compression axes of at least two resilient elements are aligned.

5. The resilient unit according to claim 4, wherein the cover sheet is arranged to extend in a direction substantially transverse to the compression axes of the at least two resilient elements.

6. The resilient unit according to claim 1, wherein the cover sheet is joined to the pocketed resilient elements at an upper side of the resilient unit in use.

7. The resilient unit according to claim 1, wherein the cover sheet is joined at a lower side of the resilient unit in use.

8. The resilient unit according to claim 1, wherein the resilient unit has upper and lower sides and comprises a cover sheet joined at each of the upper and lower sides.

9. The resilient unit according to claim 1, wherein the cover sheet is joined to one or more folds in the substantially inelastic and non-woven material of one or more of the pockets.

10. The resilient unit according to claim 1, wherein the pocketed resilient elements have one or more gussets between them, and wherein the cover sheet is joined to the one or more gussets.

11. The resilient unit according to claim 1, wherein the cover sheet is attached to the pocketed resilient elements around at least a peripheral portion of the resilient unit.

12. The resilient unit according to claim 1, wherein the resilient unit has at least one of a substantially planar upper surface and a substantially planar lower surface.

13. The resilient unit according to claim 12, wherein the cover sheet is joined at at least one of the upper planar surface and the lower planar surface.

14. An upholstered article comprising the resilient unit in accordance with claim 1.

15. The resilient unit according to claim 1, wherein the cover sheet has two major dimensions and is under tension in both dimensions.

16. The resilient unit according to claim 1, wherein the cover sheet comprises an elastomeric polymer combined with a non-elastic fibre.

17. A method of manufacturing a resilient unit, the unit comprising a plurality of resilient elements within pockets arranged in an array, the material of the pockets being substantially inelastic and non-woven, wherein the method comprises joining at least two of the pocketed resilient elements to a cover sheet of non-woven elastic material, and wherein the cover sheet has two major dimensions and is joined to the pockets by welding or by adhesive while the cover sheet is under tension in one or both of said major dimensions.

18. The method according to claim 17, wherein the pocketed resilient elements comprise springs inside the pockets.

19. The method according to claim 17, wherein the method comprises joining the cover sheet at an upper side of the resilient unit.

20. The method according to claim 17, wherein the method comprises joining the cover sheet at a lower side of the resilient unit.

21. The method according to claim 17, wherein the resilient unit has upper and lower sides, and the method comprises joining a cover sheet to each of the upper and lower sides.

22. The method according to claim 17, wherein the method comprises joining the cover sheet to one or more folds in the substantially inelastic and non-woven material of one or more of the pockets.

23. The method according to claim 17, wherein the resilient units have one or more gussets or hinges between them, and the method includes joining the cover sheet to one or more of the gussets.

24. An upholstered article formed in accordance with the method according to claim 17.

25. A method according to claim 17, wherein the cover sheet has two major dimensions, and the method comprises joining the cover sheet to the pocketed resilient elements while the cover sheet is under tension in both major dimensions.

* * * * *